US008894448B2

(12) United States Patent
Affeltranger

(10) Patent No.: US 8,894,448 B2
(45) Date of Patent: Nov. 25, 2014

(54) MULTIPOLAR OUTLET FOR A CONDUCTOR CONNECTOR SYSTEM

(75) Inventor: Walter Affeltranger, Schenkon (CH)

(73) Assignee: BKS Engineering AG, Derendingen (CH)

( * ) Notice: Subject to any disclaimer, the term of this patent is extended or adjusted under 35 U.S.C. 154(b) by 37 days.

(21) Appl. No.: 13/881,629

(22) PCT Filed: Nov. 30, 2011

(86) PCT No.: PCT/EP2011/071399

§ 371 (c)(1),
(2), (4) Date: Apr. 25, 2013

(87) PCT Pub. No.: WO2012/076382

PCT Pub. Date: Jun. 14, 2012

(65) Prior Publication Data

US 2013/0237100 A1 Sep. 12, 2013

(30) Foreign Application Priority Data

Dec. 6, 2010 (CH) ..... 2029/10

(51) Int. Cl.

| | |
|---|---|
| ***H01R 24/00*** | (2011.01) |
| ***H01R 13/6585*** | (2011.01) |
| ***H01R 4/24*** | (2006.01) |
| ***H01R 13/659*** | (2011.01) |
| ***H01R 13/6461*** | (2011.01) |
| ***H01R 13/6592*** | (2011.01) |
| *H01R 13/6477* | (2011.01) |

(52) U.S. Cl.

CPC ..... *H01R 23/005* (2013.01); *H01R 13/6585* (2013.01); *H01R 13/6477* (2013.01); *H01R 4/2433* (2013.01); *H01R 13/659* (2013.01); *H01R 13/6461* (2013.01); *H01R 13/6592* (2013.01)

USPC ..... 439/701

(58) Field of Classification Search

CPC ... H01R 13/659; H01R 23/005; H01R 13/562
USPC ..... 439/701, 469
See application file for complete search history.

(56) References Cited

U.S. PATENT DOCUMENTS 4,850,890 A * 7/1989 Kuzuno et al. ..... 439/310
5,895,292 A 4/1999 Affeltranger (Continued)

FOREIGN PATENT DOCUMENTS

| | | |
|---|---|---|
| EP | 0 809 331 | 11/1997 |
| EP | 1 311 022 | 5/2003 |
| EP | 1 901 405 | 3/2008 |

OTHER PUBLICATIONS

International Search Report Issued Dec. 22, 2011 in PCT/EP11/71399 Filed Nov. 30, 2011.

*Primary Examiner* — Briggitte R Hammond
(74) *Attorney, Agent, or Firm* — Oblon, Spivak, McClelland, Maier & Neustadt, L.L.P.

(57) ABSTRACT

A multipolar outlet for a conductor connector system. The outlet includes a housing divided into at least two chambers, each chamber including two contacts accessible from a first end of the chamber. The outlet further includes a separator for separating conductor wires and for holding the wires in place in the separator, the separator being arranged to form an end piece for the chambers at a second end, opposite to the first end, wherein the contacts are arranged to be electrically connected to the wires when the separator is in place in the housing.

14 Claims, 8 Drawing Sheets

(56) References Cited

U.S. PATENT DOCUMENTS

| | | | | |
|---|---|---|---|---|
| 6,077,122 | A * | 6/2000 | Elkhatib et al. | 439/469 |
| 6,629,858 | B2 * | 10/2003 | Lo et al. | 439/607.56 |
| 7,572,148 | B1 * | 8/2009 | Pepe et al. | 439/607.05 |
| 8,395,290 | B2 * | 3/2013 | Nass et al. | 310/71 |
| 2004/0038591 | A1 | 2/2004 | Clement et al. | |
| 2006/0246780 | A1 | 11/2006 | Bert et al. | |
| 2007/0123080 | A1 * | 5/2007 | Matsumoto et al. | 439/164 |
| 2007/0141908 | A1 | 6/2007 | Bert et al. | |
| 2011/0223796 | A1 * | 9/2011 | Reimchen | 439/460 |

* cited by examiner

MULTIPOLAR OUTLET FOR A CONDUCTOR CONNECTOR SYSTEM

TECHNICAL FIELD

The present invention relates to a multipolar outlet to be used in a conductor connector system for electrical and mechanical connection of electrical conductors. The invention likewise relates to a corresponding conductor connector system.

BACKGROUND OF THE INVENTION

The outlet according to the invention is foreseen in particular for class FA building cabling. The class determines the transmission quality of electrical signals of entire transmission lines or transmission systems from one terminal to another. In corresponding norms, such as EN 50173, limiting values are set down, for example, for the maximal cross talk attenuation, for the reflection loss, etc., as well as for the highest permissible frequencies. For class FA and future classes, working with frequencies of up to 1000 MHz and more is foreseen.

The trend in technical progress is that building cabling will no longer be provided separately for telephones, electronic data processing devices, video devices, etc., but instead only a single building cabling network is provided via which the information and data of all the services which come into question are transmitted.

The building cabling usually provided for the aforementioned purpose comprises shielded cables with eight wires or four wire pairs, respectively, each with two twisted wires. However, at most four wires or two pairs of wires, respectively, are required per service. With many connector systems used today, such as the RJ 45, at most one connector for a single service can be plugged into an outlet. If two services are required at a place of work, two outlets have to be installed next to each other. This is rather time-consuming work since more than a single service is usually required nowadays at most places of work.

Moreover it has been discovered that the aforementioned electrical transmission parameters in the connector systems of the type RJ 45 are not suitable for frequencies of over 500 MHz, and desirable magnitudes can hardly be reached. Responsible for this is the internal connection technology having usually cut/clamp connections, the wires inside the outlet or the connector of this connector system being often run bent. Moreover, it is known that in the case of the connector system RJ 45, the shielding of the individual pairs of wires is not led, or cannot be led, directly up to the connector contacts.

Furthermore, although some known solutions perform well, they are structurally rather complex and not easy for the end users to use or install.

It is the aim of the present invention to provide an improved outlet solution to be used in conductor connector systems.

SUMMARY OF THE INVENTION

According to a first aspect of the invention, a multipolar outlet for a conductor connector system is provided as recited in claim 1.

The proposed outlet offers several advantages. The outlet according to the present invention has only very few pieces and thus the mounting of the outlet is very easy. Furthermore, the wire pairs are very efficiently insulated from each other and thus crosstalk can be minimised. The good insulation is achieved thanks to the advantageous chamber structure and also thanks to the separator design. Moreover, the proposed solution guarantees that the distance between different wires remains more or less constant throughout the longitudinal distance of the outlet thereby leading to a constant impedance.

According to a second aspect of the invention, a conductor connector system comprising the multipolar outlet is provided.

Other aspects of the invention are recited in the dependent claims attached hereto.

BRIEF DESCRIPTION OF THE DRAWINGS

Other features and advantages of the invention will become apparent from the following description of non-limiting exemplary embodiments, with reference to the appended drawings, in which.

DETAILED DESCRIPTION OF AN EMBODIMENT OF THE INVENTION

Figure 1:
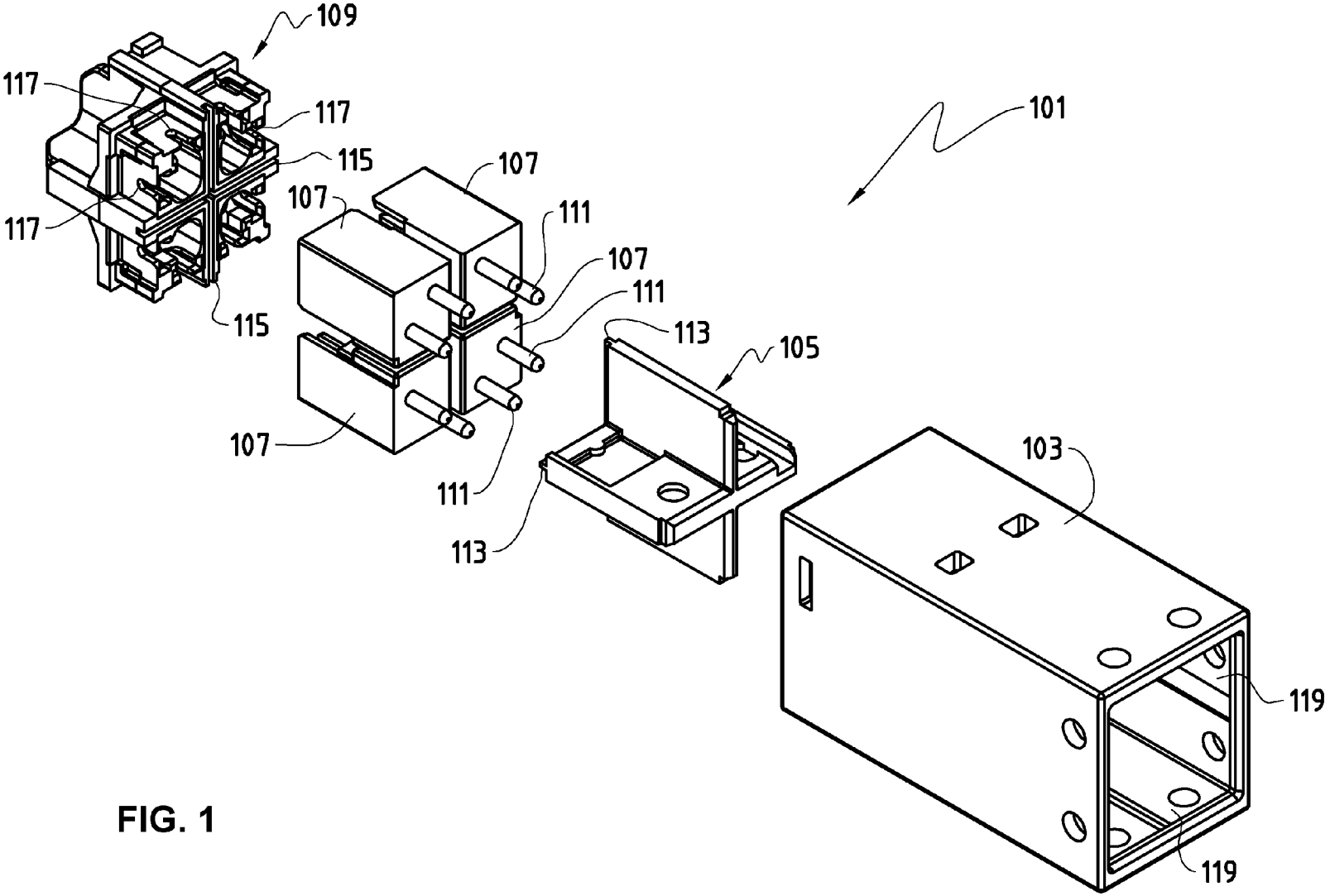
FIG. 1 is an exploded perspective view of an outlet in accordance with an embodiment of the present invention seen from the front.

An embodiment of the present invention will be described in the following in more detail with reference to the attached figures. Same reference numerals designate identical or corresponding parts throughout the several views.

Figure 2:
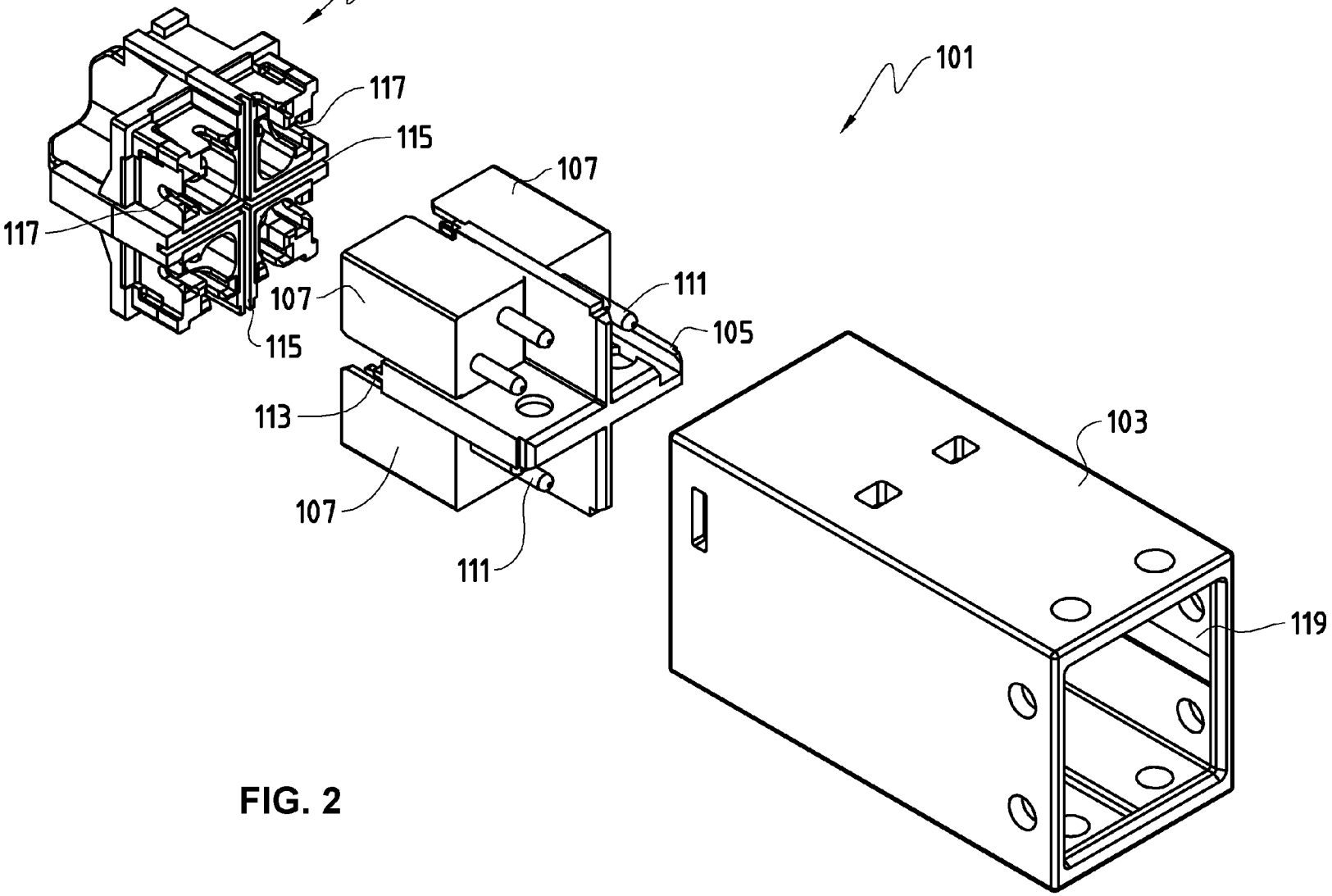
FIG. 2 is an exploded perspective view of the outlet of FIG. 1 showing inserts in place seen from the front.
Figure 3:
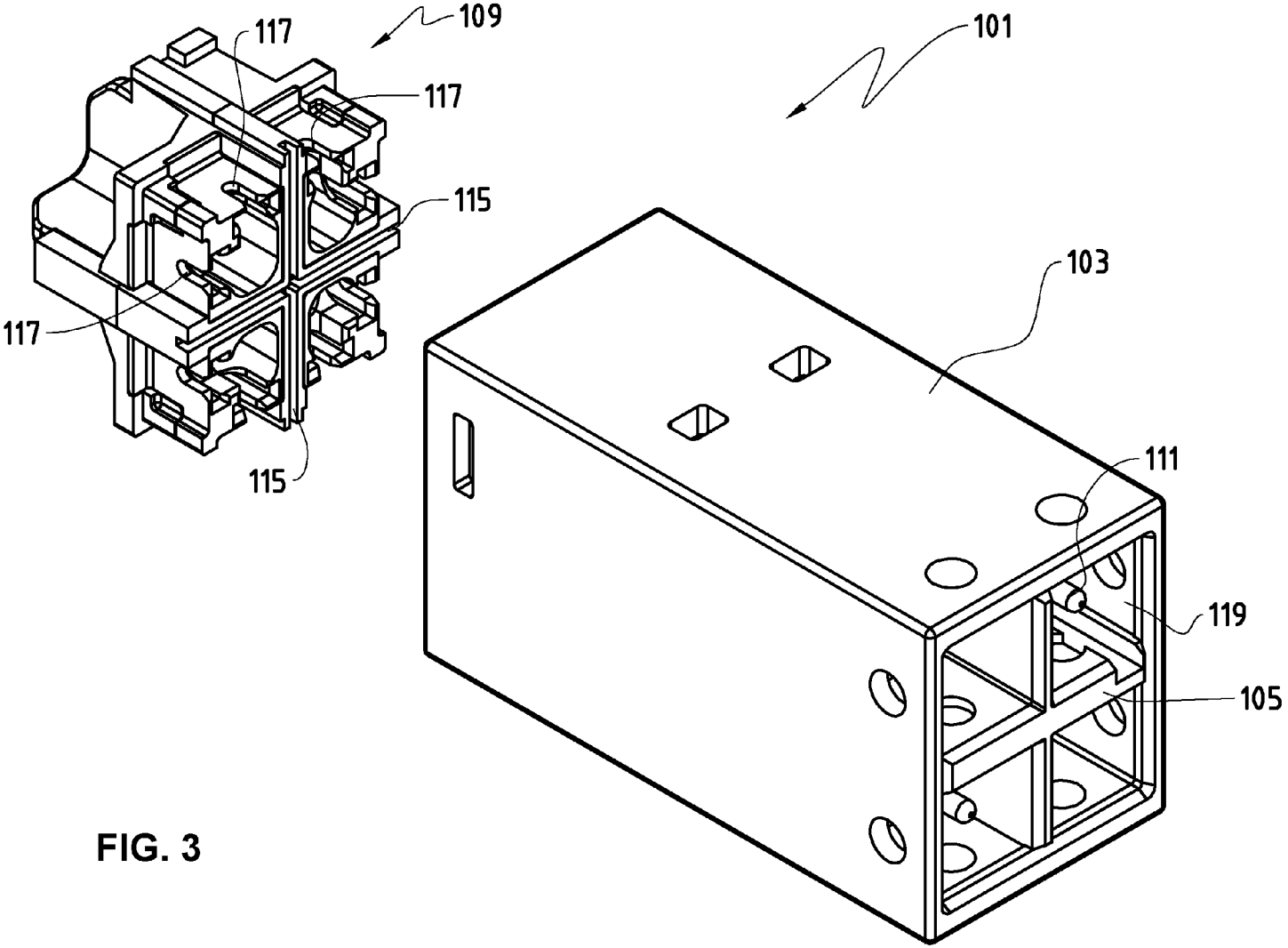
FIG. 3 is an exploded perspective view of the outlet of FIG. 1 showing a partition element together with inserts in the state of operation of the outlet seen from the front.
Figure 4:
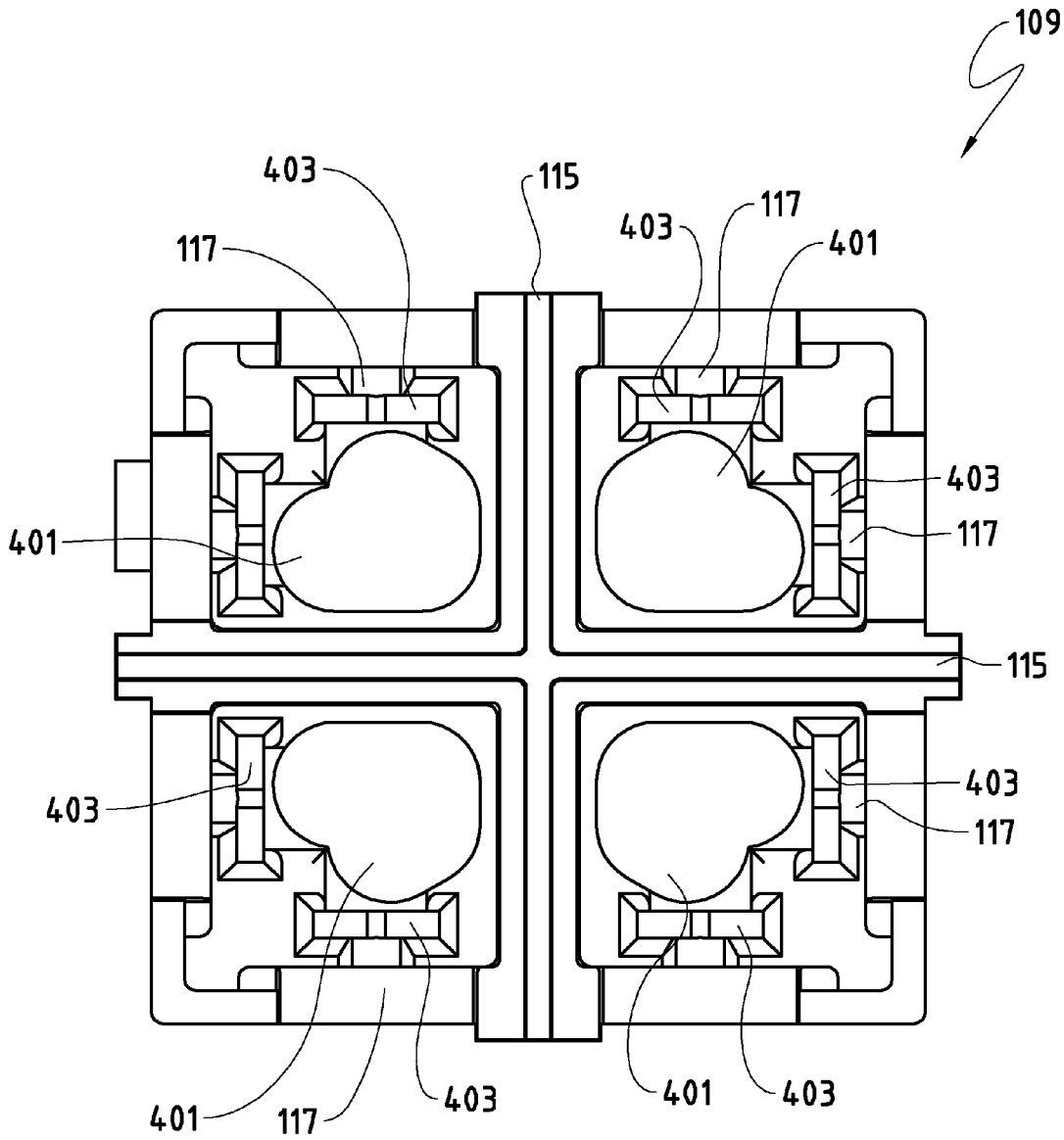
FIG. 4 is a separator of the outlet of FIG. 1 seen from the front.

FIG. 1 illustrates an exemplary outlet 101 without cable in an exploded view seen from the front according to an embodiment of the invention. The outlet 101 in this example is made of metallic material, such as zinc die-cast. The copper layer shields the outlet interior from electromagnetic fields. Applied over the copper layer is a nickel layer, intended above all for corrosion protection. The outlet 101 comprises a housing 103 which in the assembled state of the outlet contains also a metallic partition element 105, inserts 107 and a separator 109. FIG. 2 shows the partition element 105 and the inserts 107 assembled together. The partition element 105 and the inserts 107 can also be integral with the housing 103. In FIG. 3 the partition element 105 and the inserts 107 are shown in a position where the outlet 101 is operational. In this figure the partition element 105 and the inserts 107 are inside the housing 103, at the right end of the housing 103.

In the illustrated example, the housing 103 is thus divided into four chambers by the partition element 105 comprising a vertical partition and a horizontal partition. The outlet 101 is designed as a four-chamber system with four metallised chambers. Each chamber contains one insert 107, of non-conducting material in this example. Each insert has two cylindrical through holes disposed parallel to the longitudinal axis of the housing 103. Contact pins 111 or connector contacts or poles of electrically conductive material, such as metal, are situated in the holes. In other words each insert 107 thus contains two contact pins 111. The pins 111 are separated from each other by means of the inserts 107. In the operational state of the outlet 101, the contacts 111 are then accessible from the outside of the outlet 103 so that a conductor connector (not illustrated in the figures) can be connected to the contacts 111. Upon insertion of a corresponding connector counter-piece, these pins 111 enter into an electrical connection with socket connections of the counter-piece. The arrangement of the two contact pins 111 each in the four chambers is such that a protection against reversing poles is achieved. The connector of a service can be plugged in only a single position. For this purpose a groove, for instance, or a ridge can be provided on the housing 103.

The separator 109 in the operational state of the outlet 101 forms an end piece for the chambers, where the inserts 107 are located. For this purpose, provided on the partition element 105 are ridges 113 that are arranged to engage with grooves 115 on the separator 109. Thus, chambers that are well sealed electronically from the surrounding environment are obtained. Electric current is conducted through the chambers via the contacts 111. The outlet 101 of the present invention has been categorized as class FA, i.e. suitable for transmission of frequencies of up to 2400 MHz. The outlet 101 is intended for cable of the type S/STP of category 7.

Wires 701 (in FIGS. 6 and 7) of a conductor, such as a cable, are then arranged to be connected to first notches 117 of the separator 109 so that one wire 701 is connected to one notch 117. The cable (not illustrated), which is to be connected to the separator 109 and thereby to the outlet 101, comprises a plurality of wires 701, eight in this example, which run twisted in pairs through a cable sheath or jacket. Two twisted wires 701 in each case are shielded by an inner shield. An outer shield of wire mesh is positioned to enclose completely all the wires 701.

To connect the separator 109 to the cable, the jacket of the cable is first removed in an end area of the cable. The outer shield in the form of a braid is pulled back to form a layer on the cable jacket. Now from the end of the cable, the twisted wires are exposed with the inner shield.

Figure 5:
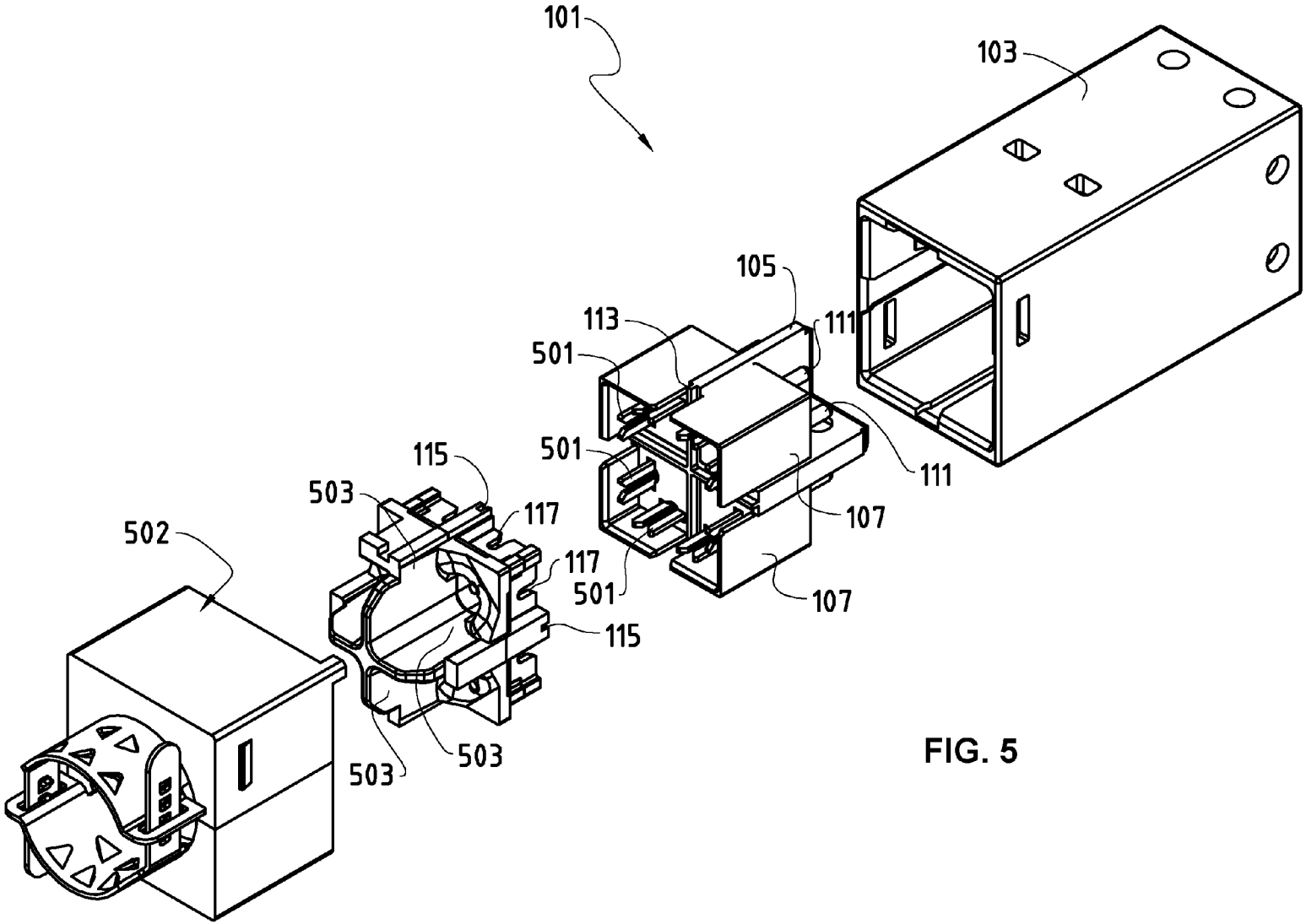
FIG. 5 is an exploded perspective view of the outlet of FIG. 1 showing the inserts in place seen from behind.
Figure 6:
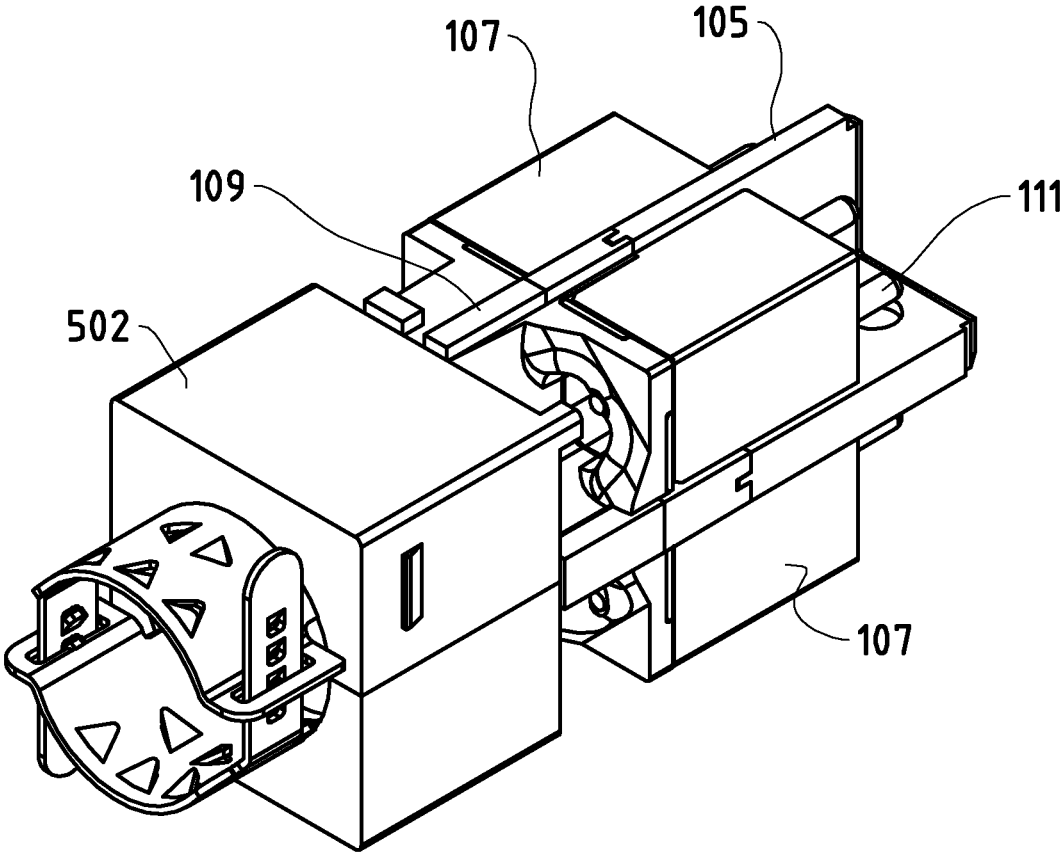
FIG. 6 is a perspective view of the outlet of FIG. 1 including a termination, but without a housing seen from the behind.
Figure 7:
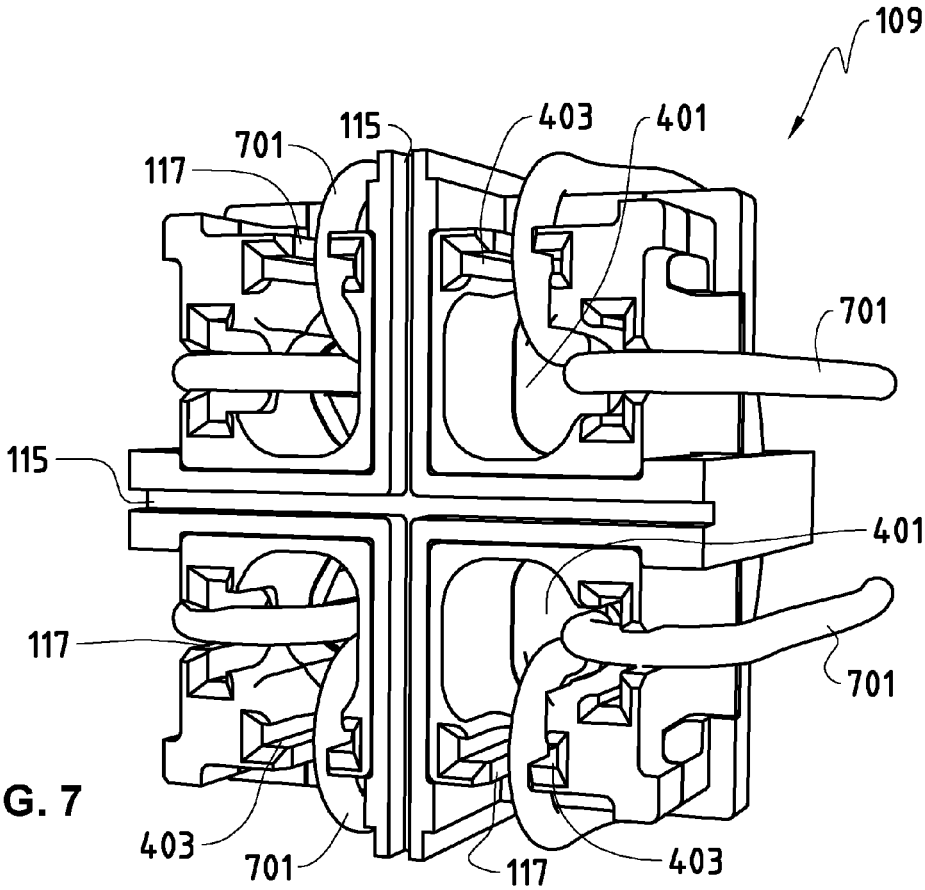
FIG. 7 is a perspective view of the separator together with wires seen from the front.
Figure 8:
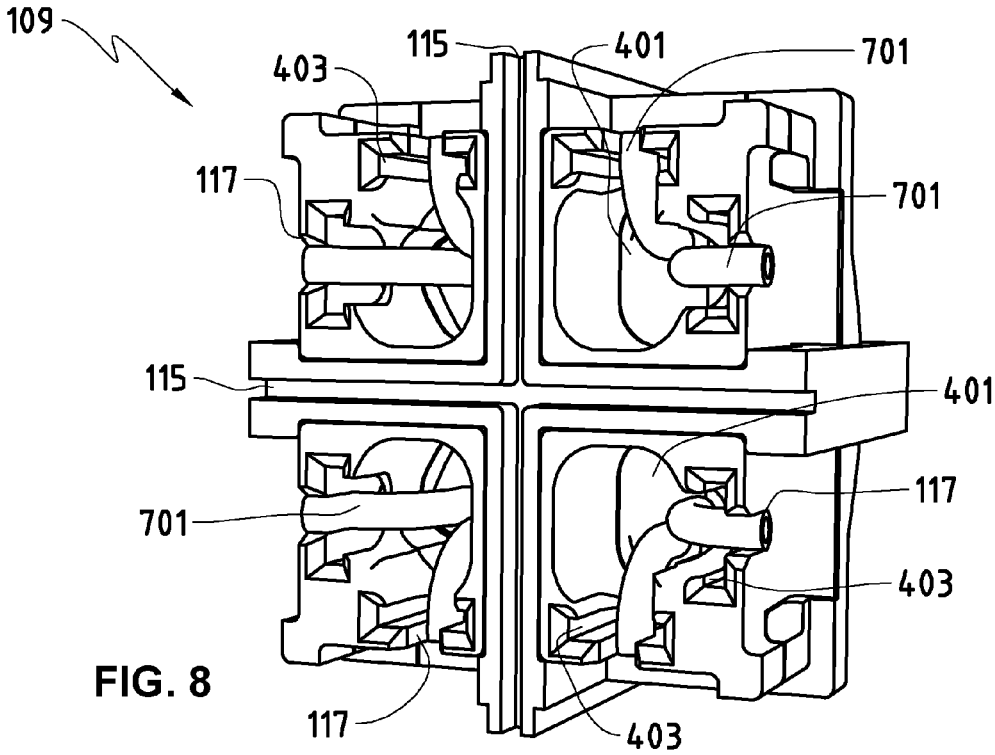
FIG. 8 is a perspective view of the separator together with the wires cut flush seen from the front.

Then a termination 502 (FIG. 5) is pulled over the braid on the jacket. Next the inner shield is removed from the end of the wires 701, however not up to the termination. Then the wires 701 are pulled through openings 401 of the separator 109, so that two wires 701 go through one opening 401. The number of openings 401 is n, while the number of wires 701 to be connected to the separator 109 is n multiplied by 2, where n is a positive integer, greater than zero. Each opening 401 is separated from another opening by a separator partition wall 503. The openings 401 and the wires 701 can be coloured in pairs, i.e. white/brown, white/green, white/orange and white/blue, so that it is easy to pull correct wires 701 through corresponding openings 401. The separator 109 is positioned so that it is physically in contact with the termination 502 (FIG. 6). The wires 701 are protected with the inner shield up to the openings 401.

Then the wires 701 are pushed tightly into the coloured notches 117, one wire for each notch. Two wires 701 passing through one opening 401 are held in place at a right angle to each other. Once the wires 701 are in place in the notches 117, the wires 701 are cut flush so that the separator 109 can be fitted into the housing 103 and engaged with the ridges 113 of the partition element 105. Now the separator 109 can be inserted into the housing 103. Advantageously the separator 109 can only be inserted into the housing 103 in a single position so that correct pins come into contact with each other. For this purpose a groove, for instance, or a ridge can be provided on the housing 103. Corresponding means are also provided on the separator 109. Once the separator 109 is inside the housing 103, cut-and-grip contact pins 501 or pliers are arranged to cut the plastic layer of the wires 701 so that these pins 501 can make an electric contact with the wires 701. These pins 501 are arranged to be inserted into second notches 403 of the separator 109 and grip the wires 701. In this manner the wires 701 are electrically connected to the contact pins 111.

Figure 9:
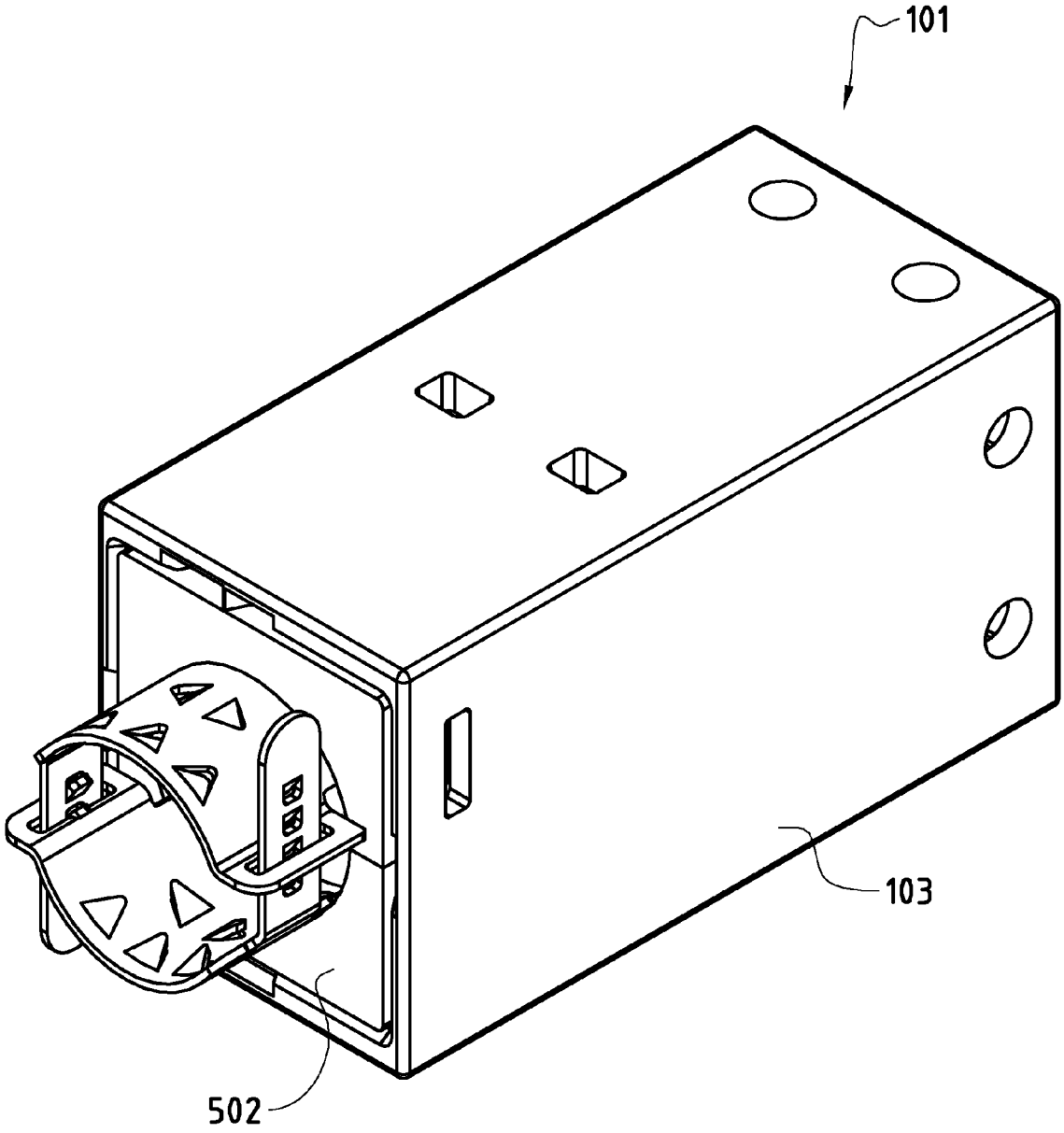
FIG. 9 is a perspective view of the outlet of FIG. 1, together with the termination seen from the behind.

FIG. 9 illustrates the outlet 101 in an assembled state showing also the termination 502 in place. However, the wires 701 are not shown in this figure. The wires are arranged to pass through an opening provided in the termination 502.

Now a connector (not illustrated in the figures) can be connected to the outlet 101 to be in contact with the pins 111. Also the inner chamber walls 119 of the outlet 101 serve to establish the contact with the connector. The connectors have parts projecting outside their housing, and these parts are provided with beryllium bronze exercising the function of a shield for the parts of the connector projecting over the housing 103. These beryllium bronze covered parts then come to contact with the outlet inner walls 119. One or two services, as desired, can be connected with the outlet 101 according to this example, per service two or four pairs of wires of the eight-core cable of the outlet being used.

The chambers obtained in accordance with the present invention are well sealed, and also the length where the wires are shielded only by the inner shielding is minimized since the wires 701 are protected by the inner shield up to the openings 401 and from the termination 502 onwards the cable is protected by the outer shield and by the jacket. For these reasons cross talk or side-to-side cross talk is prevented from occurring at high frequencies.

While the invention has been illustrated and described in detail in the drawings and foregoing description, such illustration and description are to be considered illustrative or exemplary and not restrictive, the invention being not limited to the disclosed embodiment. Other embodiments and variants are understood, and can be achieved by those skilled in the art when carrying out the claimed invention, based on a study of the drawings, the disclosure and the appended claims. In particular the number of chambers of the outlet 101 can be other than four, for instance two. Furthermore, the partition element 105 could have grooves, whereas the separator 109 would in that case have ridges.

In the claims, the word "comprising" does not exclude other elements or steps, and the indefinite article "a" or "an" does not exclude a plurality. A single processor or other unit may fulfil the functions of several items recited in the claims. The mere fact that different features are recited in mutually different dependent claims does not indicate that a combination of these features cannot be advantageously used. Any reference signs in the claims should not be construed as limiting the scope of the invention.

The invention claimed is:

1. A multipolar outlet for a conductor connector system, the outlet comprising:

a housing divided into at least two chambers, each chamber including two contacts accessible from a first end of the chamber; and a separator separating conductor wires and holding the wires in place in the separator, the separator configured to form an end piece for the chambers at a second end, opposite to the first end;

wherein the contacts are arranged to be electrically connected to the wires when the separator is in place in the housing, and wherein each wire is configured to be held in place in a first notch in the separator so that two wires passing through one opening are held in place at a right angle to each other.

2. An outlet according to claim 1, wherein the two chambers are separated from each other by a partition element.

3. An outlet according to claim 2, wherein the partition element includes a ridge arranged to be inserted into a groove of the separator.

4. An outlet according to claim 1, wherein the outlet and the separator include means for allowing the separator to be inserted into the housing in one position only.

5. An outlet according to claim 1, wherein the separator includes openings for the wires to pass through.

6. An outlet according to claim 5, wherein each opening allows two wires to pass through, a number of openings being n, while a number of wires to be connected to the separator being n multiplied by 2, n being a positive integer greater than zero.

7. An outlet according to claim 5, wherein each opening is separated from another opening by a separator partition wall.

8. An outlet according to claim 1, wherein the contacts run through inserts parallel to the longitudinal axis of the housing.

9. An outlet according to claim 1, wherein the contacts are in a form of pliers at the second end.

10. An outlet according to claim 9, wherein the pliers are configured to cut a plastic layer of the wire and to hold the wire in place.

11. An outlet according to claim 9, wherein the pliers are arranged to be inserted into second notches in the separator when the separator is in place in the housing.

12. An outlet according to claim 1, wherein each chamber includes an insert of a non-conducting material for separating the contacts from each other.

13. A connector system comprising the outlet according to claim 1, and further comprising a conductor including at least four shielded wires.

14. A connector system according to claim 13, further comprising a connector connected to the contacts.

* * * * *